United States Patent [19]

Moraw et al.

[11] Patent Number: 4,478,924

[45] Date of Patent: Oct. 23, 1984

[54] PROCESS FOR TRANSFERRING A PIGMENT IMAGE USING A SPACER

[75] Inventors: Roland Moraw; Renate Schaedlich, both of Wiesbaden, Fed. Rep. of Germany

[73] Assignee: Hoechst Aktiengesellschaft, Frankfurt am Main, Fed. Rep. of Germany

[21] Appl. No.: 314,456

[22] Filed: Oct. 23, 1981

[30] Foreign Application Priority Data

Nov. 20, 1980 [DE] Fed. Rep. of Germany ..... 3043736

[51] Int. Cl.[3] ..... G03G 13/16

[52] U.S. Cl. ..... 430/126; 430/119; 355/3 TR

[58] Field of Search ..... 430/117, 118, 119, 126; 355/3 TR

[56] References Cited

U.S. PATENT DOCUMENTS

| | | | |
|---|---|---|---|
| T869,004 | 12/1969 | Culhane . | |
| 2,839,400 | 6/1958 | Moncrieff-Yeates | 430/126 X |
| 2,892,708 | 6/1959 | Walkup . | |
| 3,071,645 | 1/1963 | McNaney | 430/126 X |
| 3,203,394 | 8/1965 | Hope et al. | 430/126 X |
| 3,560,204 | 2/1971 | Damm, Jr. . | |
| 3,806,354 | 4/1974 | Amidon et al. | 430/118 X |
| 3,891,434 | 6/1975 | Taege et al. | 430/117 |
| 3,933,490 | 1/1976 | Tsuchiya | 430/117 X |
| 3,972,718 | 8/1976 | Weigl | 430/63 |
| 4,364,661 | 12/1982 | Landa | 355/35 H |

FOREIGN PATENT DOCUMENTS

| | | | |
|---|---|---|---|
| 2651427 | 5/1978 | Fed. Rep. of Germany | 430/126 |
| 23635 | 10/1965 | Japan | 430/126 |
| 2075919 | 11/1981 | United Kingdom | 355/3 TR |

OTHER PUBLICATIONS

Masham, "Liquid Developer Applicator", Xerox Discl. Jour. vol. 2, No. 3, May/Jun. 1977, p. 91.

Culhane, Abstract of SN 706120, filed 2/16/68, published in 869 O.G. 711 on 12/16/69.

*Primary Examiner*—Roland E. Martin

*Attorney, Agent, or Firm*—Schwartz, Jeffery, Schwaab, Mack, Blumenthal & Koch

[57] ABSTRACT

A process for transferring a pigment image, produced by treating an electrostatic charge image with liquid developer, from a charge image carrier to a copy carrier with the aid of an electric field, the liquid developer layer having a pigment distribution arranged according to the image, being transferred across a small air gap, preferably having a width of 5–50 μm.

9 Claims, 4 Drawing Figures

PROCESS FOR TRANSFERRING A PIGMENT IMAGE USING A SPACER

BACKGROUND OF THE INVENTION

The present invention relates to a process for transferring a pigment image, prepared from an electrostatic charge image by treatment with a liquid developer, from a charge image carrier to a copy carrier, with the aid of an electric field.

The transport of liquid ink or toner to a charge pattern, by means of a transport surface in order to develop charge images is disclosed in U.S. Pat. No. 3,560,204. In the described process, the surface carrying the charge image is moved past an ink drum at a small distance, and a potential is applied to the conducting ink drum so that the colorant is attracted to the regions of the charge image. Although the application of liquid can be reduced by such a development process, and the image areas can be relatively well reproduced in the form of a statistical grid, it has been found, however, that the reproduction of half-tones is remarkably unsatisfactory. This also cannot be improved by varying the spacing between the charge image and the ink drum.

Another problem encountered with liquid development processes for electrostatic images is pollution of the environment arising from evaporation of substantial amounts of the dispersing fluid from the liquid developer.

There remains a need for an electrostatic copying process which comprises developing an electrostatic charge image and transferring the developed pigment image, which results in little environmental pollution and which also provides a good half-tone reproduction in view of the generally high state of copying technology.

SUMMARY OF THE INVENTION

It is the object of the present invention to provide an improved process for transferring a pigment image produced by treating an electrostatic charge image with a liquid developer, from a charge image carrier to a copy carrier with the aid of an electric field.

A further object of the present invention is to provide an improved process for transferring a pigment image produced by treating an electrostatic charge image with a liquid developer which enables good half-tone reproduction.

Yet another object of the present invention is to provide a process for transferring a pigment image produced by treating an electrostatic charge image with a liquid developer which reduces the consumption of liquid developer compared to conventional image transfer processes.

It is also an object of the present invention to provide a process for transferring a pigment image produced by treating an electrostatic charge image with a liquid developer which reduces environmental pollution by decreasing the evaporation of liquid dispersant from the liquid developer.

These and other objects of the invention are achieved by providing a process for transferring a pigment image produced by treating an electrostatic charge image with liquid developer, wherein the liquid developer layer, which has a pigment distribution arranged according to the image, is transferred across a small air gap. Preferably, the air gap has a width of from 5 to 50 μm. The required air gap can be provided in a simple manner by using spacers. The quantity of liquid developer used for developing which is present on the charge image carrier is advantageously reduced before the transfer step.

The invention provides a copying process which functions with liquid development and by means of which copies can be prepared having half-tone reproductions which meet high quality requirements while simultaneously incurring reduced pollution of the environment as a result of liquid evaporation. It was not to be expected that such a result could be achieved by carrying out the comparatively simple measures of the present invention in conjunction with a customary development technique.

Any previously known material on which charge images are electrographically or electrophotographically produced can be used as the charge carrier. Suitable materials include those having insulating surfaces, such as dielectric papers, films or drums with an insulating covering layer. Photoconductive materials are preferably utilized. Any desired photoconductor materials are suitable. For example, the photoconductor may be a band-shaped photoconductor made of a polyester support film, coated with a vapor-deposited layer of aluminum, and having a photoconductive layer of materials such as poly-N-vinylcarbazole and trinitrofluorenone. Inorganic photoconductor materials, for example those based on selenium or zinc oxide, can also be employed.

Conventional pigment dispersions used for making charge images visible can be used as the liquid developer. These generally comprise a liquid hydrocarbon as the dispersing liquid and pigments which are dispersed therein, optionally with further additives. The dispersed pigments are usually ionically charged.

Paper sheets, of the type customarily employed in electrostatic copying devices, can be used as the copy carrier. Films, including modified paper sheets or foils with surface structures, which enable the formation of a sufficient air gap between the charge image carrier and the copy carrier, are preferably utilized.

The development of the latent electrostatic charge images is effected in a conventional manner by electrophoretic deposition of the charged pigments, as the complete surface of the charge image carrier is wetted with developer liquid. Under these circumstances, the deposited pigment quantity is substantially proportional to the charge density.

The transfer according to the invention is achieved with commercial liquid developers for charge images. The charge images may be produced by various techniques, for example electrostatically with pen electrodes, or by photoconduction. The transfer may also be effected using a liquid developer comprising an organic or aqueous liquid, in which either electrically neutral pigments are dispersed or colorants are dissolved.

The identity of the particular development process is not critical for the transfer according to the invention, and, for example, any other known technique can also be used. The preferred embodiment of the invention is the transfer of the developer liquid layer after a previous electrophoretic development.

According to the invention, the pigment image, which has been made visible with developer liquid, is transferred with the aid of an electric field from the charge image carrier, across an air gap, onto the copy carrier, without contact. The transfer has heretofore been customarily effected by contact transfer in which the copy carrier, with wetting of the complete surface, was applied or pressed onto the charge image carrier which was provided with developer liquid, while simultaneously being subjected to action of a homogeneous electric field. Desirably, the thickness of the transferred liquid developer layer is not greater than 10 μm. The air gap is determined by means of spacers which comprise up to 10 percent, preferably not more than about 2 percent, of the copy carrier surface and which may move with the charge image carrier and the copy carrier, or may also be fixedly positioned. Spacers which are integral with the surface of the copy carrier are particularly suitable.

BRIEF DESCRIPTION OF THE DRAWINGS

The invention will be described in further detail with reference to the accompanying drawings, wherein.

DETAILED DESCRIPTION OF PREFERRED EMBODIMENTS

Figure 1:
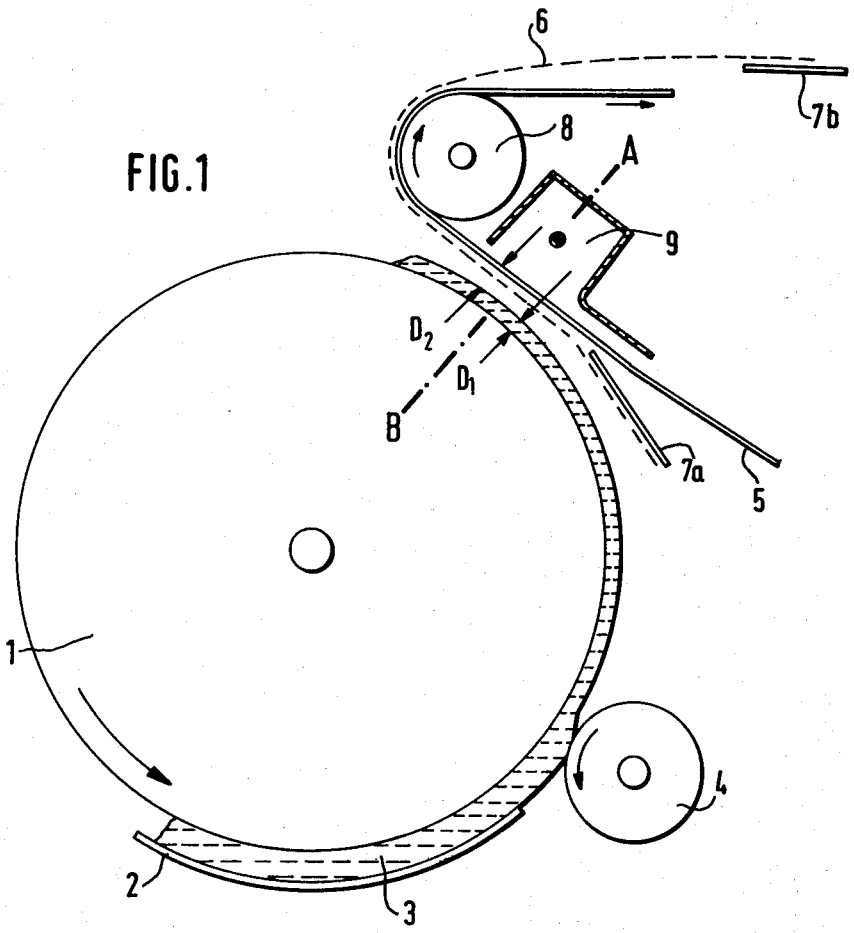
FIG. 1 is a schematic representation of the development of a latent electrostatic image and the transfer according to the invention.

Referring now to FIG. 1, the invention will be described in more detail in conjunction with the individual process steps in a commercially available copying device with liquid development.

Figure 1A:
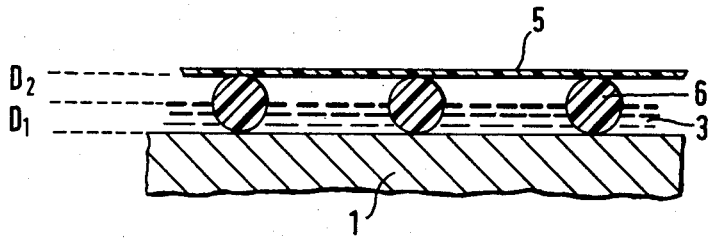
FIG. 1A is a partial sectional view taken along the line A–B of FIG. 1.

A charge image on photoconductor drum 1, which has, for example, a selenium coating, is treated, in the region of a development electrode 2, with a developer liquid 3. The thickness of the liquid film remaining on the photoconductor drum 1 is reduced by the doctor roll 4. For the transfer process, the copy material 5 is passed, at a distance D2, over the layer of developer liquid of thickness D1. As can be seen from the cross-sectional representation in FIG. 1*a*, thin monofilaments which have a diameter of 40 μm and which are spaced apart distances from 3 to 5 mm are stretched between guide plates 7*a* and 7*b* and around the reversing roller 8, to serve as spacers 6. The transfer corona, which is operated at approximately +6 kV, is designated by reference numeral 9. Copies are obtained which are somewhat light, but which exhibit very good half-tone reproduction. The transferred pigment image is composed of a statistical distribution of points having diameters of 50 to 100 μm and exhibiting varying darkness. By weighing a relatively large number of copies produced with the thermofixing switched off, it is determined that in the gap transfer procedure of the invention, the consumption of dispersing liquid is reduced by 30 percent to 50 percent compared to the conventional contact transfer procedure in the same copying device. Various aliphatic hydrocarbons having boiling points ranging between about 150 and 230° C. are utilized as the dispersing liquid.

As described above, the gap D2 is established between the charge carrier layer provided with developer liquid and the copy carrier surface by means of filaments which are oriented in the direction of movement and which serve as spacers. The filaments are installed as part of the copy machine. By varying the filament thickness, the most favorable gap width for space D2 is determined to be 50 μm or less depending upon the strength of the applied electric transfer field. The transfer corona 9, which is located at a distance of about 1 cm from the photoconductor drum 1, is supplied with a voltage of +6.1 kV. If the corona voltage decreases to only +5.4 kV, the efficiency of the transfer is noticeably poorer. The strength of the transfer field is on the order of magnitude of 10 kV/cm.

Another technique for establishing the air gap of the invention by means of spacers between the charge carrier surface and the copy carrier surface comprises allowing a perforated web, such as a fine mesh used for screen printing, or a perforated foil with a large proportion of hole area, to run concomitantly between the two surfaces. The copies exhibit some interference due to the filaments or to the straps between the holes. However, the optimum spacing can be more precisely established using this technique. It has been found that copies prepared using an air gap of 28 μm in width established using appropriate perforated films, yield dense or black image points of good quality, whereby the half-tone reproduction by statistically distributed points is good.

The technique, used in this preferred embodiment, of a concomitantly running spacer between the charge carrier surface and the copy carrier surface can be advantageously achieved by integrating the spacer into the copy carrier surface. For this purpose the copy carrier, such as a commercial copying paper for electrophotographic copying devices or even a foil or film, is provided with a colorless or white pigment or polymer dispersion of prescribed particle size.

Figure 2:
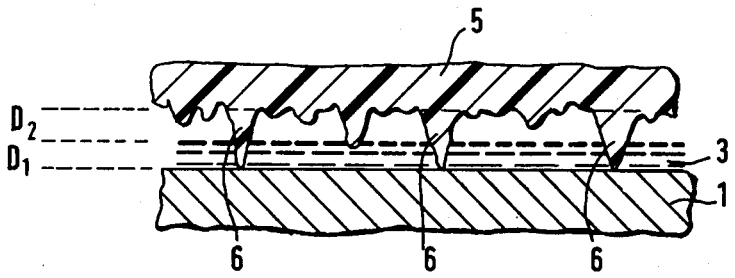
FIG. 2 is a cross-sectional view through the layers in the transfer process, one of the layers having a surface structure.

One can also use a copy carrier having a surface in which a particular structure is embossed. An example of such a surface is illustrated in FIG. 2 which is a cross-sectional view of a thermoplastic film of, for example, polyvinyl chloride, with a statistically roughened surface. The surface structure which ultimately determines the quality of the copies in the gap transfer process can be very precisely measured using commercially available structure measuring devices, and this surface structure can then be prepared, for example, by means of embossing rollers. The smallest measured width for the gap D2 according to the invention is about 5 μm. In particular, good and reproducible copies are obtained with gap widths of between 8 μm and 25 μm, for which reason this range has proven to be particularly preferred.

Additionally, the appearance of the copies is also determined by the contact area of the spacers which are in contact with the charge carrier layer, in comparison to the total area of the copy carrier. It has been found that the relative contact area should be less than 10 percent of the total area. Preferably, it is less than, or equal to, about 2 percent of the total area. It has further been found that the area effectively occupied by a single spacer, which area is visible by its impression on the copy surface, should be smaller than about 0.04 $mm^2$. Preferably, the area occupied by a single spacer should be smaller than 0.01 $mm^2$, if possible. The average distance between adjacent spacers can be less than about 3 mm, preferably less than 1 mm. The surface stretched between the spacers may be smooth or finely structured.

If the doctor roll 4 limits the liquid layer to a thickness of 12–14 μm, good copies are obtained using spacers having thickness of about 25 to 30 μm. It can be concluded therefrom that the width of the air gap and the thickness of the liquid layer to be transferred should preferably be of similar size. In the case of a more volatile dispersing agent with an evaporation number of 36 (ether = 1), part of the dispersing liquid already evaporates on the way from the doctor roll 4 to the transfer station, so that the thickness of the liquid layer is smaller at the latter point. However, a large amount of evaporation is undesirable in such a case because of the increase in the viscosity of the liquid developer. It can be suppressed with increasing effectiveness by using correspondingly less volatile dispersing agents, i.e, those having higher evaporation numbers. It has been found thereby, for example, using a dispersing agent with a high evaporation number, that, with a liquid layer thicknesses on the charge image carrier of 12–14 μm, the consumption of dispersing liquid by copies made with a gap transfer process according to the invention is of equal magnitude in copies of completely white originals as in copies of originals 10 percent covered by pictorial or written material.

If the distance between the doctor roll 4 and the surface of the charge carrier 1 is reduced by means of a shrink film on the doctor roll, for example a shrink film as disclosed in German patent application No. P 30 21 050.5, so that the thickness of the liquid developer layer with a dispersing agent of high evaporation number amounts to only about 8 μm or about 3 μm, the quality of the copies does not change noticeably with respect to the maximum density and the half-tone reproduction of the images composed of points. However, the consumption of dispersing liquid decreases greatly in the case of such thin layers. Surprisingly, the decrease is greater at the toner-free points than at the points where there is toner. The consumption decreases to only about 9 percent of the initial value in the case of contact transfer of a completely white original, and to only about 14 percent for an original with 10 percent image coverage.

Figure 3:
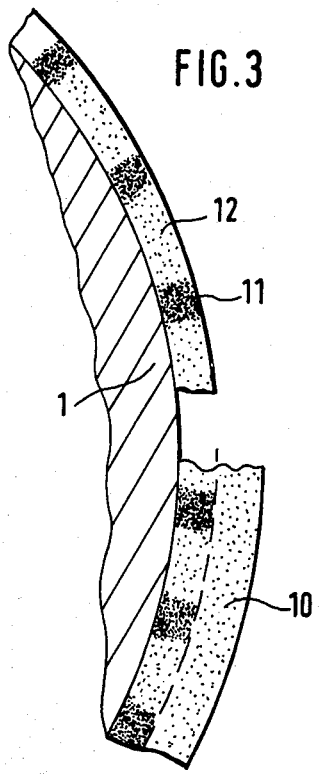
FIG. 3 is a schematic illustration of the concentration of pigment particles in a liquid developer layer applied to the charge carrier.

In embodiments utilizing liquid developer layers D1 of not more than 8 μm thickness, the liquid layer very probably consists, as illustrated in FIG. 3, predominantly of regions of high pigment concentration 11 and of regions of low pigment concentration 12. In these thin liquid layers, the pigment-poor outer layer portion 10 is presumably removed with the aid of the doctor roll 4. The thickness of this residual liquid layer is less than 8 μm and can amount to about 3 μm or less.

The foregoing embodiments have been described merely as illustrative examples of the invention and are not intended to be limiting. Since modifications of the disclosed embodiments incorporating the spirit and substance of the invention may occur to persons skilled in the art, it is intended that the scope of the invention is to be limited solely with respect to the appended claims and equivalents.

We claim:

1. A process for transferring a pigment image produced by treating an electrostatic charge image with a liquid developer, from a charge image carrier to a copy carrier with the aid of an electric field, said process comprising transferring the liquid developer layer which has a pigment distribution arranged according to the image, across an air gap having a gap width lying in the range from 5 to 50 μm, said air gap being established by inserting a spacer built in as part of the copy machine between the charge image carrier and the copy carrier, said spacer having a contact area not greater than 10 percent of the area of the copy carrier.

2. A process according to claim 2, wherein said gap width lies in the range from 8 to 25 μm.

3. A process according to claim 1, wherein said spacer comprises a plurality of parallel monofilaments oriented in the direction of motion of the charge image carrier surface and the copy carrier surface.

4. A process according to claim 3, wherein said monofilaments have a diameter of about 40 μm and a spacing between adjacent filaments of from 3 to 5 mm.

5. A process according to claim 4, wherein said spacer moves along with the charge image carrier and the copy carrier.

6. A process according to claim 5, wherein said spacer comprises a perforated web disposed between the charge image carrier and the copy carrier.

7. A process according to claim 1, wherein the contact area of the spacer is not greater than 2 percent of the area of the copy carrier.

8. A process according to claim 1, wherein the average distance between spacer elements is less than about 3 mm.

9. A process according to claim 8, wherein the average distance between spacer elements is less than about 1 mm.

* * * * *